United States Patent [19]

Gunther et al.

[11] Patent Number: 4,494,654

[45] Date of Patent: Jan. 22, 1985

[54] SALAD BAR INSERT

[75] Inventors: Arthur G. Gunther; Douglas H. Willsie; Leo D. Hawkins, all of Wichita, Kans.

[73] Assignee: Pizza Hut, Inc., Wichita, Kans.

[21] Appl. No.: 438,932

[22] Filed: Nov. 3, 1982

[51] Int. Cl.[3] ..... B65D 1/34

[52] U.S. Cl. ..... 206/562; 206/45.31; 206/486; 206/563; 426/115; 426/19

[58] Field of Search ..... 206/562, 557, 485, 486, 206/563, 45.31; 220/23.83, 23.86; 426/108, 109, 115, 119, 120, 113

[56] References Cited

U.S. PATENT DOCUMENTS

| | | | |
|---|---|---|---|
| 1,688,888 | 10/1928 | Spreen | 206/562 |
| 1,761,483 | 6/1930 | McGinnis | 220/23.83 |
| 2,048,041 | 7/1936 | Warren et al. | 220/23.83 |
| 2,565,912 | 8/1951 | Davis | 206/562 |
| 3,240,610 | 3/1966 | Cease | 426/120 |
| 3,351,192 | 11/1967 | Plante | 206/486 |
| 3,352,479 | 11/1967 | Mohs | 206/557 |
| 3,542,280 | 11/1970 | Crabtree | 206/564 |
| 3,580,485 | 5/1971 | Hall | 206/557 |
| 3,608,770 | 9/1971 | Naimell | 426/120 |
| 3,865,953 | 2/1975 | Peters | 426/119 |
| 3,887,069 | 6/1975 | Diwo | 220/23.86 |
| 3,983,993 | 10/1976 | Hsu | 220/23.86 |
| 4,314,650 | 2/1982 | Cillario | 206/562 |
| 4,328,254 | 5/1982 | Waldburger | 220/23.83 |
| 4,386,703 | 6/1983 | Thompson et al. | 206/557 |

FOREIGN PATENT DOCUMENTS

| | | | |
|---|---|---|---|
| 1443571 | 5/1966 | France | 206/562 |
| 1116157 | 6/1968 | United Kingdom | 206/563 |

*Primary Examiner*—Joseph Man-Fu Moy
*Assistant Examiner*—David Fidei
*Attorney, Agent, or Firm*—Willian Brinks Olds Hofer Gilson & Lione Ltd.

[57] ABSTRACT

A salad bar insert is disclosed which includes upper and lower panels which are bonded together. The upper and lower panels define openings sized to receive containers of salad foods. In addition, the upper and lower panels define a sealed interior volume which surrounds the various openings. Three-dimensional salad food replicas are secured in place to the lower panel inside this chamber, such that the three-dimensional salad food replicas are visible from above through the upper panel. The insert of this invention can readily be wiped clean, and it allows a salad bar to be assembled simply and easily, with minimal labor requirements.

9 Claims, 4 Drawing Figures

SALAD BAR INSERT

BACKGROUND OF THE INVENTION

This invention relates to a salad bar insert which can be used to display salad bar foods in an inviting and attractive manner.

Salad bars have become an important part of a wide variety of restaurants. Typically, salad bars include containers of a number of salad foods, such as lettuce, tomatoes, green peppers, onions, and the like, as well as several salad dressings. Salad bars are designed to allow consumers to make their own salads by selecting foods and dressings. Thus, the consumer actually works with the salad bar in preparing his salad, and the appearance of the salad bar is therefore important. A salad bar which is presented attractively and neatly can be an asset to a restaurant, both in terms of creating a pleasing atmosphere, as well as in terms of inviting consumers to try the salad bar.

One approach which has been taken in the past in assembling a salad bar is to place containers of salad foods in a mound of flaked ice inside the cold pan of a refrigeration table. The flaked ice is disposed around the containers, and it provides a clean, refreshing aspect to the salad bar. In order further to improve the appearance of the salad bar, it has been common practice to decorate the flake ice with vegetables such as kale.

The flaked ice approach to building a salad bar has the advantage of presenting an inviting and appealing salad bar. However, this approach can be labor intensive, both in the initial assembly and final disassembly of the salad bar, and in the maintenance required to keep it clean. Of course, consumers will drop and drip foods from containers onto the flake ice as they make salads. Considerable attention and time can be required to maintain a flaked ice salad bar in a clean and appealing condition, and the labor costs of building and maintaining a flaked ice salad bar can be considerable.

SUMMARY OF THE INVENTION

It is a primary object of this invention to provide a salad bar insert which is inviting and appealing to consumers, yet which can readily be cleaned by simple wiping.

According to this invention, a salad bar insert is provided for a salad bar of the type which includes a table and a plurality of salad food containers. The salad bar insert of this invention defines a plurality of openings and a display region situated between the openings. Each of the openings is sized and shaped to receive a respective one of the containers, and the openings are distributed such that the display region is visible between the containers. The display region has an upper surface which is adapted readily to be wiped clean, and the insert further includes a plurality of three-dimensional salad food replicas which are held in place inside the salad bar insert beneath the upper surface of the display region. The upper surface, which is transparent, serves to protect the salad food replicas from dirt and wear yet the replicas are clearly visible from above the salad bar insert through the upper surface. In use, the salad bar insert is secured in place on a table, and the insert serves to retain the salad food containers in place in the openings. The preferred embodiment described below rises above the major horizontal plane of the salad bar surface.

It has been found that the combination of an inset and three-dimensional food replicas provides an appealing salad bar. The salad food replicas cooperate with and serve to set off the salad foods in the containers in a distinctive, refreshing, and inviting manner. Yet the distinctive appearance of the salad bar insert of this invention is achieved in a manner which minimizes labor costs. The salad bar insert can readily be cleaned by wiping with a towel, and a salad bar which incorporates the insert of this invention can be assembled merely by placing the filled salad food containers in the openings defined by the insert. Thus, both in terms of assembly and maintenance, salad bars utilizing the insert of this invention require a minimum of labor.

Furthermore, the salad bar insert of this invention can provide significant cost savings in materials and capital expenses. The cost of flaked ice and vegetables such as kale which are used to make a flaked ice salad bar is completely avoided. Furthermore, in many cases, a restaurant which utilizes the salad bar insert of this invention will have no need for a machine to make flaked ice. For many restaurant requirements, cubed ice is preferable to flaked ice. In the past, many restaurants have been required to have cubed ice machines for most restaurant purposes as well as a flaked ice machine for salad bar requirements. Often, by substituting the salad bar insert of this invention for flaked ice salad bars, the need for a flaked ice machine can be avoided.

The invention itself, together with further objects and attendant advantages, will best be understood by reference to the following detailed description, taken in conjunction with the accompanying drawings.

BRIEF DESCRIPTION OF THE DRAWINGS

In FIG. 4, the insert is shown in end view.

DETAILED DESCRIPTION OF THE PRESENTLY PREFERRED EMBODIMENTS

Figure 1:
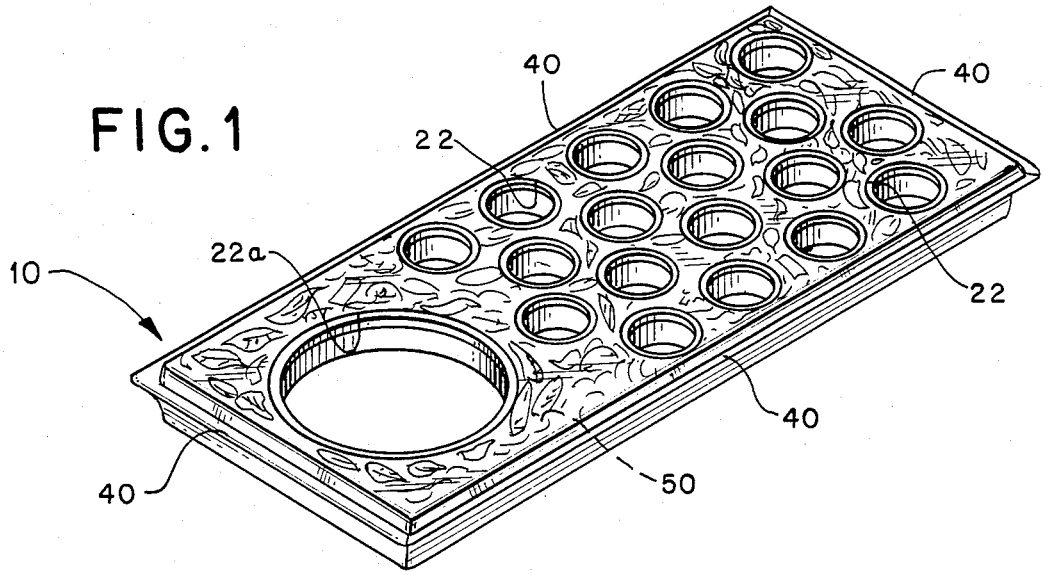
FIG. 1 is a perspective view of the presently preferred embodiment of the salad bar insert of this invention.
Figure 2:
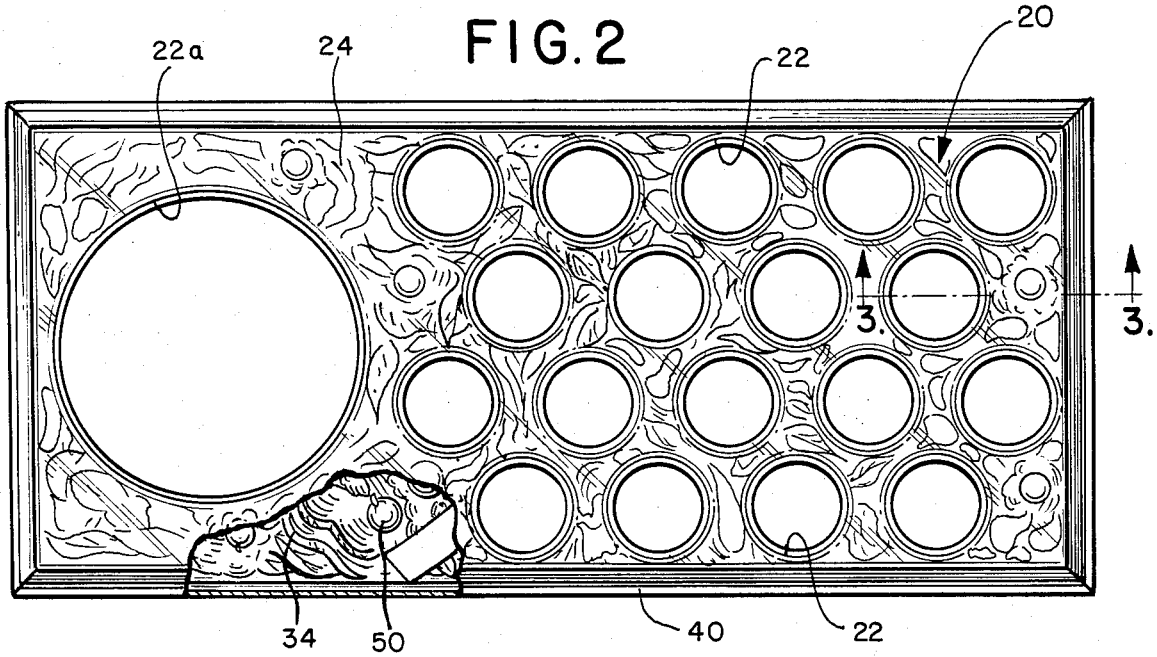
FIG. 2 is a top plan view of the insert of FIG. 1.
Figure 3:
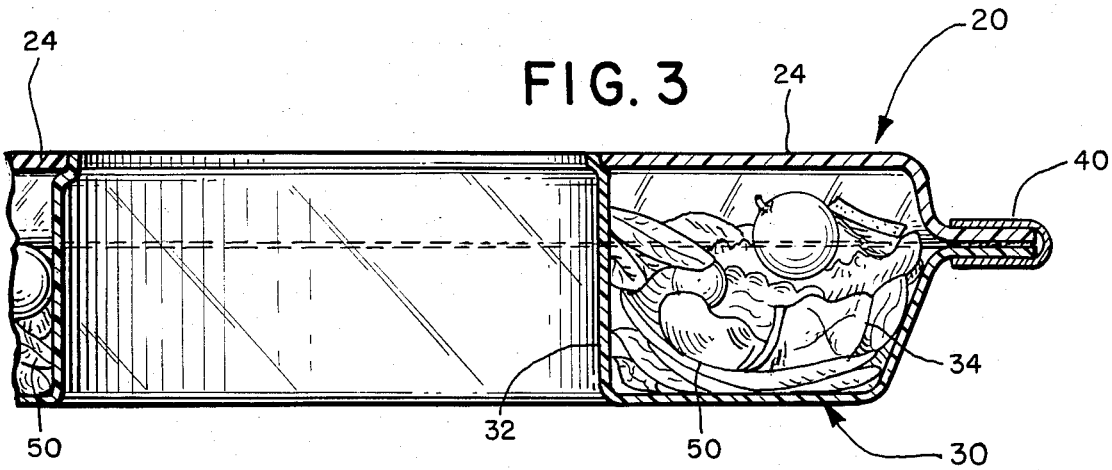
FIG. 3 is a sectional view taken along line 3—3 of FIG. 2.
Figure 4:
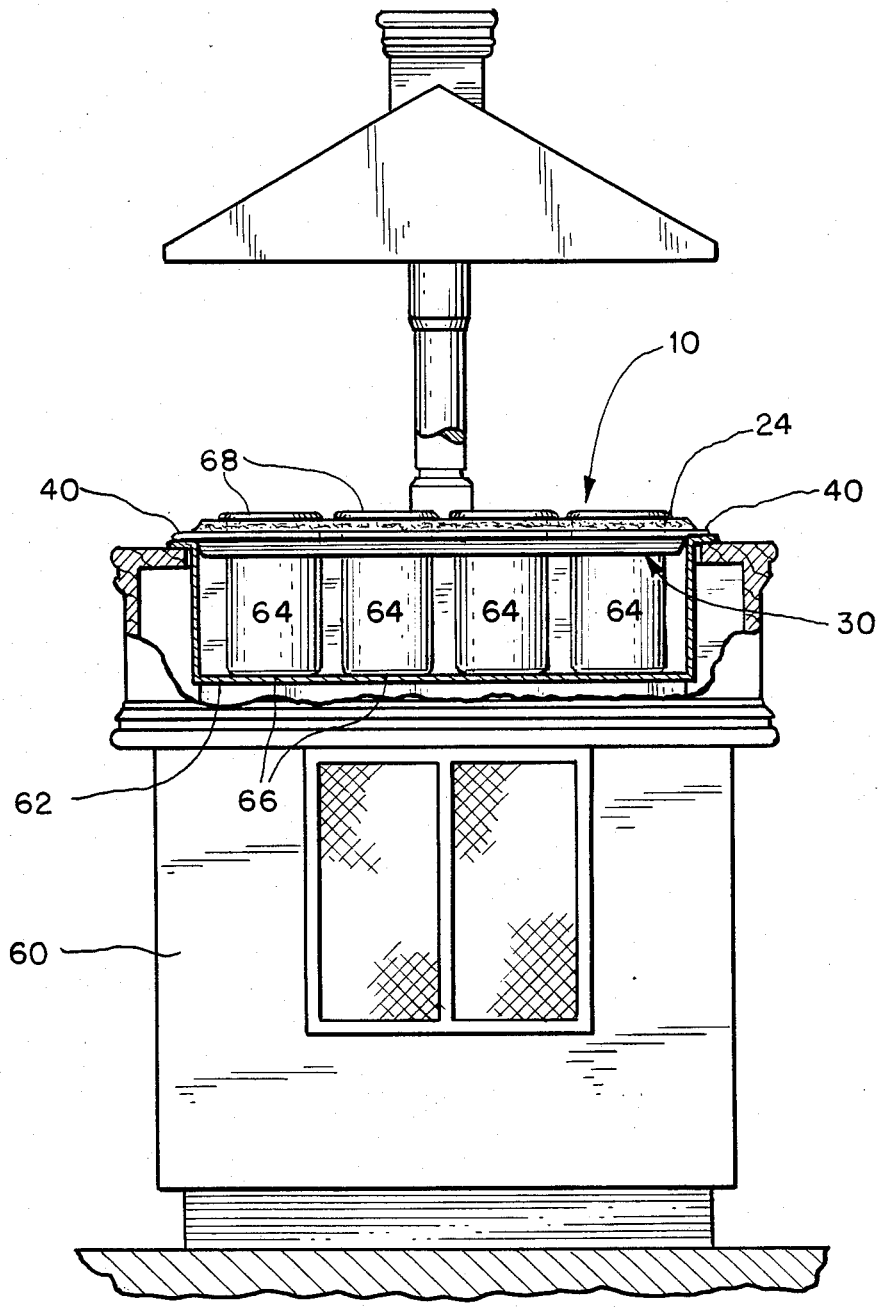
FIG. 4 is a partial cutaway view of a salad bar which incorporates the insert of FIGS. 1–3.

Turning now to the drawings, FIGS. 1–3 show various views of a salad bar insert built in accordance with the present invention, and FIG. 4 shows a cutaway view of the insert of FIGS. 1–3 in use.

As shown in FIGS. 1 and 2, the insert 10 of this embodiment is a panel which is rectangular in shape and which defines a plurality of openings 22, **22*a*. The single large opening 22*a* is used to retain a container for lettuce or other greens, and the small openings 22 are used to retain other salad food containers. The region between the openings 22, 22*a* forms a display region 24**, which is described in detail below.

As shown in FIG. 3, the insert 10 is formed of a upper panel 20 and a lower panel 30. In this embodiment, the upper panel 20 is formed of a transparent plastic sheet about 3/16" thick, while the lower panel 30 is formed of an opaque, vacuum formed plastic about ⅛" thick. The upper panel 20 defines openings 22, **22*a*, while the lower panel 30 defines correspondingly situated walled openings 32. The insert 10 is assembled by cementing the upper panel 20 to all adjoining surfaces of the lower panel 30 to form a sealed interior volume or chamber 34** in the area of the display region 24 between the openings 22, 22*a*. Preferably, the insert 10 is constructed such that the chamber 34 is sealed against leakage or contamination by dust or other materials. A rim strip 40 surrounds the perimeter of the insert 10. In this preferred embodiment, the rim strip 40 is formed of stainless steel in four sections, one for each side of the insert 10. The rim strip 40 simultaneously serves two functions. First, it serves to secure the upper and lower panels 20, 30 together mechanically, to increase the strength and rigidity of the insert 10. Second, the rim strip 40 serves as a lip or flange to mount the insert 10 over a refrigeration table, as shown in FIG. 4.

Before the upper and lower panels 20, 30 are cemented together, a wide variety of salad food replicas 50 are cemented to the inside surface of the lower panel 30, such that they will be positioned inside the chamber 34 under the display region 24 of the finished insert 10.

These salad food replicas 50 are three-dimensional, life-like replicas of salad components. Each is colored in a realistic manner, and the overall effect of the salad food replicas 50 as seen through the transparent upper panel 20 is that of a bed of lettuce which completely covers the display region 24, and a plurality of cherry tomatoes, slices of green pepper, mushrooms, red cabbage, onion, cheese and the like, which are distributed randomly over the bed of replica lettuce. In this way, the salad food replicas 50 seen in the display region 24 surround the openings 22, 22*a* with a replica of a salad.

In the presently preferred embodiment, the salad food replicas are supplied by Iwasaki Industries of Torrance, Calif. Table 1 presents the quantities of salad food replicas which are used in one presently preferred embodiment of the insert 10, which measures approximately 50 inches in length, 22 inches in width, and 2 inches in depth.

TABLE I

Identification of Types and Quantities of Salad Food Replicas Used in Presently Preferred Embodiment

| | |
|---|---|
| Bacon Bits | 27–30 |
| Red Kidney Beans | 26–29 |
| Beet Slices | 11 |
| Carrot Slices | 12 |
| Cauliflower Pieces | 6 |
| Celery Sticks | 18 |
| Chedder Cheese Strips | 2½ oz. |
| Croutons | 30–33 |
| Cucumber Slices | 10 |
| Green Pepper Slices | 16 |
| Mushroom Slices | 25 |
| Onion Slices | 20–23 |
| Radish Slices | 21 |
| Lettuce Pieces | 6 lbs. |
| Red Cabbage Strips | 2½ oz. |
| Cherry Tomatoes | 14 |

FIG. 4 shows an end view in partial cutaway of a salad bar 60 which utilizes the insert 10 described above. This salad bar 60 includes a conventional refrigeration table, and is of the type designed to form a free standing salad bar in the center of a room. The salad bar 60 defines a cold pan 62 which includes a horizontal refrigeration surface. The salad bar insert 10 is suspended over the cold pan 62 by the rim strip 40.

Typically, the first step in assembling a salad bar utilizing the insert 10 of this invention is to clean the cold pan 62 and then to place the clean insert 10 in place over the cold pan 62. Then a number of salad food containers 64, each containing a respective salad food, are placed in respective ones of the openings 22,22*a*. Typically, lettuce or other greens are placed in a large bowl in the opening 22*a*, while salad foods (such as peppers, olives, green peppers, radishes, bacon bits, croutons, cheese and the like) are placed in containers in the smaller openings 22. Of course, the particular salad foods used in the various containers 64 form no part of the present invention and can be chosen as desired.

Each of the containers 64 defines an upper lip 68 which prevents the container 64 from passing through the insert 10. In addition, each of the containers 64 defines a flattened bottom 66 which is designed to rest on the cold pan 62 in thermal contact with the cold pan 62.

In order to maintain the salad foods in the containers 64 in a cold, crisp condition, it has been found preferable to form the salad food containers 64 out of a thermally conducting material, such as stainless steel. In assembling the salad bar shown in FIG. 4, each of the containers and its associated salad food is first refrigerated, then all of the refrigerated components are placed in respective ones of the openings 22,22*a* to complete assembly of the salad bar. If desired, the salad food containers 64 can be provided with plastic coated upper lips 68 to give them the appearance of crockery.

From the foregoing description it should be apparent that a salad bar insert has been described which provides the illusion of fresh, three-dimensional, realistic salad foods surrounding the various salad food containers. Salad bars utilizing the insert of this invention can quickly and efficiently be assembled as described above. In addition, the time and effort needed to maintain a salad bar which incorporates the insert of this invention in a clean and attractive condition is minimal. This is because the upper panel 20 is provided with a relatively flat and featureless upper surface which can readily be wiped clean. Thus, the insert of this invention combines the advantages of easy cleaning with the attractive appearance of three-dimensional salad food replicas. Moreover, the insert of this invention acts as a thermal barrier, which closes the cold pan 62 around the containers 64.

Of course, it should be understood that a range of changes and modifications to the preferred embodiment described above will be apparent to those skilled in the art. For example, the shape of the insert and the size, shape and number of the openings in the insert can all be varied as necessary to meet the requirements of individual applications. Furthermore, the construction techniques described above are not essential to all forms of this invention, and it may be preferable in some applications to build the salad bar insert of this invention out of other materials using other construction techniques. For example, the walls of the openings can be formed by cylindrical components which are secured to upper and lower surfaces. Alternatively, the three-dimensional vegetable replicas can be imbedded in a transparent material. It is therefore intended that the foregoing detailed description be regarded as illustrative rather than limiting, and that it be understood that it is the following claims, including all equivalents, which are intended to define the scope of this invention.

We claim:

1. In a salad bar of the type comprising a table and a plurality of salad food containers, the improvement comprising:

a salad bar insert which defines a plurality of openings and a display region situated between the openings, each of the openings sized and shaped to receive a respective one of the salad food containers, the openings distributed such that the display region is visible between the openings, the display region having an upper surface which is adapted readily to be wiped clean;

a plurality of three-dimensional salad food replicas;

means for retaining the salad food replicas in the salad bar insert beneath the upper surface of the display region such that the upper surface protects the replicas from dirt, said upper surface being transparent such that the replicas are visible from above the salad bar insert through the upper surface; and means for retaining the insert in place on the table.

2. The invention of claim 1 wherein each of the salad food containers is formed of a thermally conductive material and defines a flattened bottom surface, wherein the table is a refrigeration table which defines a flat refrigeration surface, and wherein the insert is dimensioned to position the containers in the openings with the flattened bottom surfaces in thermal contact with the refrigeration surface.

3. The invention of claim 1 wherein the retaining means for the salad food replicas comprises a lower surface which cooperates with the upper surface to define an enclosed chamber within the insert, the salad food replicas being disposed within the chamber.

4. The invention of claim 1 wherein the salad food replicas comprise lettuce replicas and a plurality of vegetable replicas, and wherein the replicas are secured to the lower panel in a pattern which defines a bed of the lettuce replicas with the vegetable replicas distributed thereon, as seen through the transparent upper panel.

5. The invention of claim 4 wherein the salad food replicas cover substantially all of the display region.

6. In a salad bar of the type which comprises a refrigeration table and a plurality of salad food containers, the improvement comprising:

a salad bar insert including:

a transparent upper panel;

a lower panel;

means for securing the upper and lower panels together such that a sealed interior space is formed therebetween;

said upper and lower panels defining walled openings passing therethrough, each of which is sized to receive a respective salad food container, and a display region situated between the openings;

a plurality of three-dimensional salad food replicas positioned in the interior space in the display region between the walled openings such that the replicas are visible through the transparent upper panel; and means for holding the upper and lower panels in place over the refrigeration table.

7. The invention of claim 6 wherein each of the containers is formed of a thermally conductive material and defines a flattened bottom surface, wherein the refrigeration table defines a flat refrigeration surface, and wherein the insert is dimensioned to position the containers in the openings with the flattened bottom surfaces in thermal contact with the refrigeration surface.

8. The invention of claim 6 wherein the salad food replicas comprise lettuce replicas and a plurality of vegetable replicas, and wherein the replicas are secured to the lower panel in a pattern which defines a bed of the lettuce replicas with the vegetable replicas distributed thereon, as seen through the transparent upper panel.

9. The invention of claim 8 wherein the sealed food replicas cover substantially all of the display region.

* * * * *